US007185794B2

(12) United States Patent
Poindexter et al.

(10) Patent No.: US 7,185,794 B2
(45) Date of Patent: Mar. 6, 2007

(54) GARMENT SECURITY HANGER AND DISPLAY SYSTEM

(76) Inventors: Michael Poindexter, 8 Spring St., #8re, New York, NY (US) 10012; Eric Watts, 195 Chrystie St., #501g, New York, NY (US) 10002

( * ) Notice: Subject to any disclaimer, the term of this patent is extended or adjusted under 35 U.S.C. 154(b) by 349 days.

(21) Appl. No.: 10/896,761

(22) Filed: Jul. 22, 2004

(65) Prior Publication Data

US 2005/0077326 A1 Apr. 14, 2005

Related U.S. Application Data

(60) Provisional application No. 60/489,144, filed on Jul. 22, 2003.

(51) Int. Cl.
*A41D 27/22* (2006.01)

(52) U.S. Cl. ..... 223/85

(58) Field of Classification Search ..... 223/85–98
See application file for complete search history.

(56) References Cited

U.S. PATENT DOCUMENTS 4,088,228 A * 5/1978 Schwalbe ..... 211/4
4,540,092 A 9/1985 DeSantis
4,615,447 A 10/1986 Walter
4,624,371 A 11/1986 Korth
4,739,912 A * 4/1988 Klawieter et al. ..... 223/85
5,016,758 A 5/1991 Ward
D319,360 S * 8/1991 Walter ..... D6/411
D329,951 S * 10/1992 Walter ..... D6/411
D329,952 S * 10/1992 Walter ..... D6/411
D329,953 S * 10/1992 Walter ..... D6/411
D330,122 S * 10/1992 Walter ..... D6/411
5,823,407 A * 10/1998 Mayer et al. ..... 223/85

* cited by examiner

*Primary Examiner*—Shaun R. Hurley
(74) *Attorney, Agent, or Firm*—Ober/Kaler; Royal W. Craig

(57) ABSTRACT

A garment security hanger and display comprising one or more hanger assemblies, one or more lock rod assemblies, and a base. Each hanger assembly comprises a hanger body with an integral locking device and indicator mechanism. The present invention provides for the placement of a garment on a hanger assembly before the hanger assembly is releasably attached to a lock rod assembly. The lock rod assembly is typically inserted through a sleeve of the garment before being inserted into a channel formed in the hanger assembly. When the lock rod assembly is fully inserted into the channel, the locking device is engaged and the indicator flags the locked status. The hanger assembly may be unlocked by a key inserted in the locking device, allowing the lock rod assembly to be extracted. The present invention possesses a simple, yet scalable, design for economical manufacture and widespread retail use.

4 Claims, 11 Drawing Sheets

GARMENT SECURITY HANGER AND DISPLAY SYSTEM

CROSS-REFERENCE TO RELATED APPLICATIONS

The present application derives priority from U.S. Provisional Application Ser. No. 60/489,144; filed: Jul. 22, 2003.

BACKGROUND OF THE INVENTION

1. Field of the Invention

The present invention relates to the display of garments and other products for sale and, more particularly, security devices intended prevent garment/product theft, and even more particularly, to a secure hanger and display system with a releasable lock for use with a variety of garment/product types.

2. Description of the Background

In retail stores, conventional sales techniques for garments and other products require that they be displayed on racks and hangers such that consumers may readily view them and, when appropriate, remove them from the rack/hanger for the purpose of trying them on. However, theft of such merchandise, particularly expensive garments, from such display racks/hangers is a serious problem. This is true not only in retail stores, but even in cloakrooms and restaurants. Efforts to overcome the problem of garment/product theft have resulted in variety of security devices and, therefore, the present inventor is not the first to address means for securely displaying items for sale. For example, devices geared toward a solution are found in U.S. Pat. No. 4,624,371 to Korth, U.S. Pat. No. 5,016,758 to Ward, and U.S. Pat. No. 4,540,092 to DeSantis.

U.S. Pat. No. 4,624,371 to Korth discloses a security clothes-stand containing a number of holding rods which are retained in a supporting device, and on the top end of the device is mounted a clothes-hanger for receiving an article of clothing to be presented. The holding rods essentially consist of a base tube that is connected rigidly to the supporting device and on which a casing tube is rotatably mounted. The casing tube carries at its top end a lock attachment that contains a snap-in catch designed for the releasable retention of the clothes-hanger. A holding member of the clothes-hanger can be inserted into a receiving orifice in the snap-in catch and can be removed from the lock attachment only after the catch in the latter has been released. Unfortunately, the point at which the holding member is inserted in the lock attachment is often difficult to access, for the purpose of removing the article of clothing from the security clothes-stand, due to its position at an end of the hanger where it typically resides at the junction between the shoulder portion and sleeve section of a sleeved garment.

U.S. Pat. No. 5,016,758 to Ward discloses a security device for clothing wherein a strong flexible cable is fastened at one end to a lock, carried on a hanger, or to a bar on a clothing stand. The cable is passed through part of a garment such as a sleeve and the other end of the cable is detachably secured in the lock to releasably secure the garment.

U.S. Pat. No. 4,540,092 to DeSantis discloses a rack for securely displaying clothes while permitting the clothing to be tried on by a consumer. The rack includes a support stand and a hanger support bar mounted on the stand. The hanger support bar is hollow and has an elongated slot formed therein with a plurality of apertures along its length joined with the slot. Individual elongated flexible guard members having enlarged head portions at one end fit in any one of the apertures while preventing withdrawal through the slot. The guard members pass through a portion of a garment placed on a conventional hanger. Removal of the guards from the hanger support bar is prevented by a blocking device that can be moved between first and second positions to block the apertures. The end of the guard members which pass through the clothing are secured to a blocking device on the base of the display stand for preventing removal of a garment therefrom.

Unfortunately, the Ward and DeSantis devices, due to their use of flexible cables to secure clothing to a display stand, may be extremely tedious to utilize in a busy retail environment. Each time a consumer wants to try on a secured article of clothing, the flexible cable must be unlocked and removed from the sleeve of the garment by a salesperson and, if a sale is not made, the salesperson must place the cable back in position within the sleeve(s) of the garment before relocking the cable.

To the best of the knowledge of the present inventors, no prior design exists to address the problems outlined above. Consequently, it would be greatly advantageous to provide a garment security hanger and display apparatus that (1) possesses a readily accessible locking device, (2) possesses a rigid design that is easily removed from and returned to its working position within a garment, (3) possesses a simple, yet scalable, design fabricated of durable, lightweight materials, and (4) may be economically manufactured and sold to provide for widespread use.

SUMMARY OF THE INVENTION

It is, therefore, the primary object of the present invention to provide an improved garment security hanger and display apparatus possessing an improved design for preventing the theft of the item displayed for sale.

A further object of the present invention is to provide an apparatus that possesses a readily accessible locking device.

Yet another object of the present invention is to provide an apparatus that possesses a rigid design that is easily removed from its working position within a garment. Another object of the present invention is to provide an apparatus that possesses a rigid design that is easily returned to its working position within a garment.

Still another object of the present invention is to provide an apparatus that possesses a simple and scalable design.

It is another object of the present invention to provide an apparatus that is fabricated of lightweight materials providing an appropriate degree of durability/longevity.

An additional object of the present invention is to provide an apparatus that is inexpensive to manufacture and sell to provide for widespread use.

According to the present invention, the above-described and other objects are accomplished by a garment security hanger and display apparatus comprising one or more hanger assemblies, one or more lock rod assemblies, one or more support rod assemblies, and a base assembly. Each hanger assembly comprises a hanger body with an integral locking device and indicator mechanism. Each lock rod assembly comprises a lock rod and a ball end. Each support rod assembly comprises a support rod, a collar, a sleeve bearing, and a flange bearing. The base assembly is generally floor-mounted and comprises a base, a post, a post collar, and one or more multi-rod support bars.

The present invention provides for the placement of a garment on a hanger assembly before the hanger assembly is releasably attached to a lock rod assembly. To facilitate the attachment of the hanger assembly to the lock rod assembly, the lock rod assembly is typically inserted through a sleeve of the garment before being inserted into a channel formed in the hanger assembly. When the lock rod assembly is fully inserted into the channel, the locking device is engaged to maintain the attachment of the hanger assembly to the lock rod assembly. To facilitate the detachment of the hanger assembly from the lock rod assembly, the locking device, located proximate the center of the hanger assembly in a position that is typically unobstructed by any part of the garment, is unlocked allowing the lock rod assembly to be extracted from the channel.

The present invention is fabricated of strong, lightweight materials chosen to provide an appropriate degree of durability/longevity. The present invention possesses a simple, yet scalable, design that may be economically manufactured and sold to provide for widespread use. Alternative embodiments incorporate wall-mounted base assemblies in place of the floor-mounted variation.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE PREFERRED EMBODIMENTS

Figure 1:
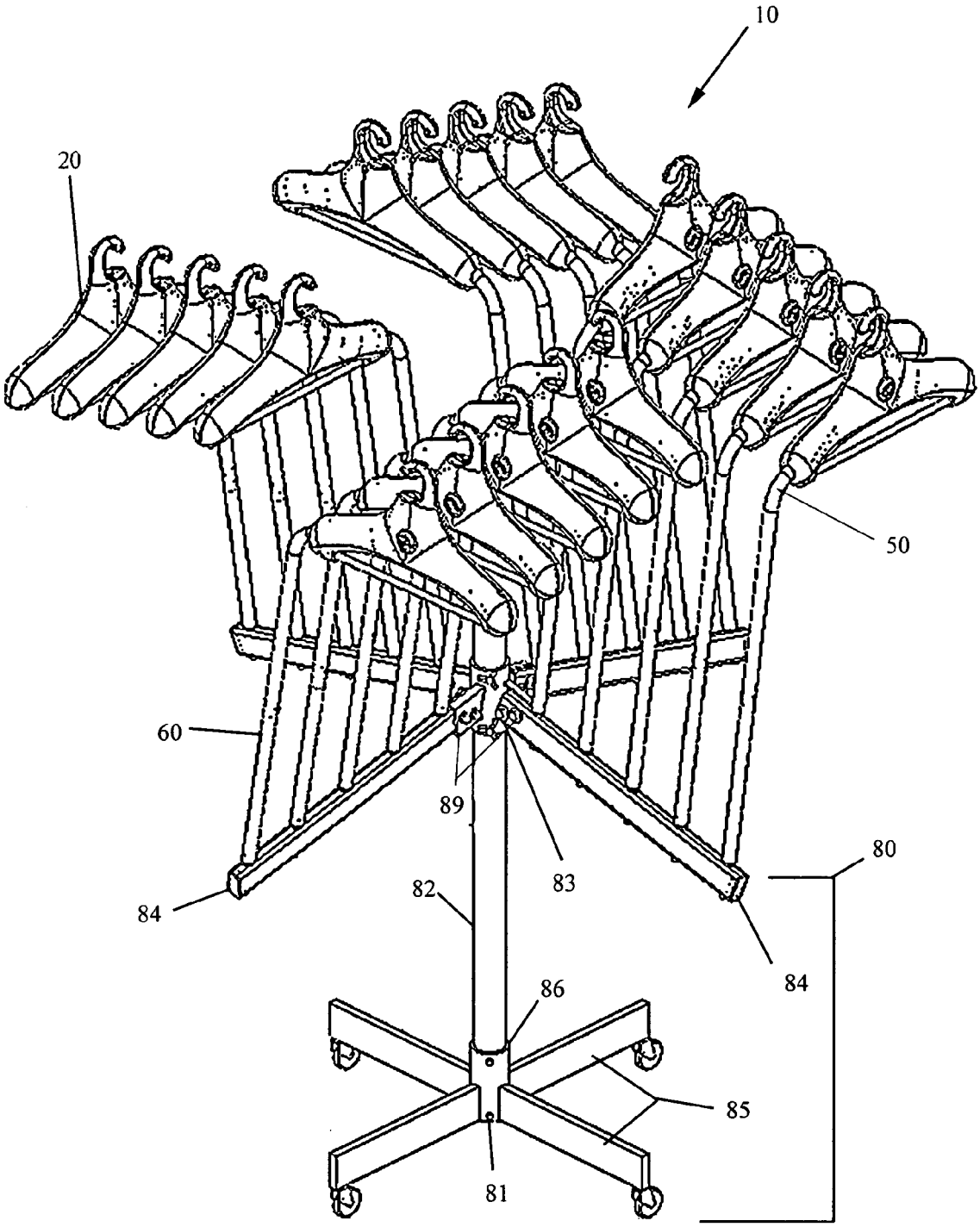
FIG. 1 is a perspective view of a garment security and display apparatus 10 according to a preferred embodiment of the present invention.

FIG. 1 is a perspective view of a garment security and display apparatus 10 according to a preferred embodiment of the present invention. The garment security and display apparatus 10 typically comprises one or more hanger assemblies 20, a corresponding number of lock rod assemblies 50, each lock rod lock rod assembly 50 being mounted on a support rod assembly 60, and a base assembly 80.

Figure 2:
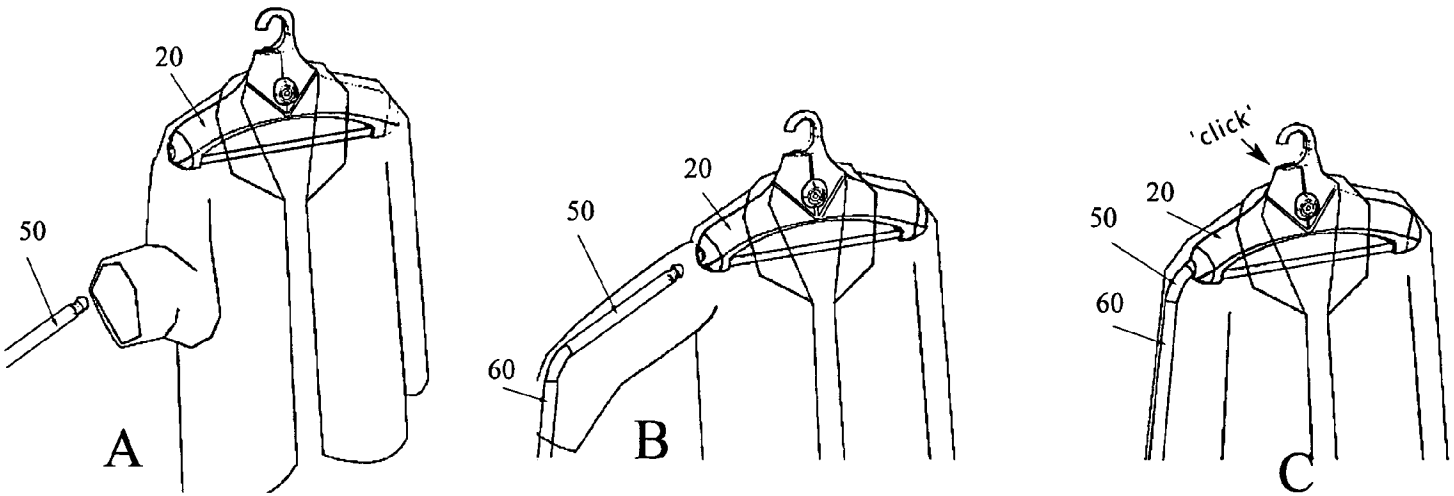
FIG. 2 is a sequential illustration showing the manner of using the garment security and display apparatus 10.

FIG. 2 is a sequential illustration showing the manner of using the garment security and display apparatus 10. In use, a hanger assembly 20 is inserted into the garment (such as a mink coat), and the sleeve of the garment is inserted over the lock rod assembly 50 and integral support rod assembly 60 as seen at ref. A. As shown at B, the lock rod assembly 50 and support rod assembly 60 is extended upward through the garment sleeve toward the hanger assembly 20. Finally, as seen at C, the lock rod assembly 50 is inserted into a channel formed in the hanger assembly 20 and is releasably locked in place with a "click.".

Figure 3:
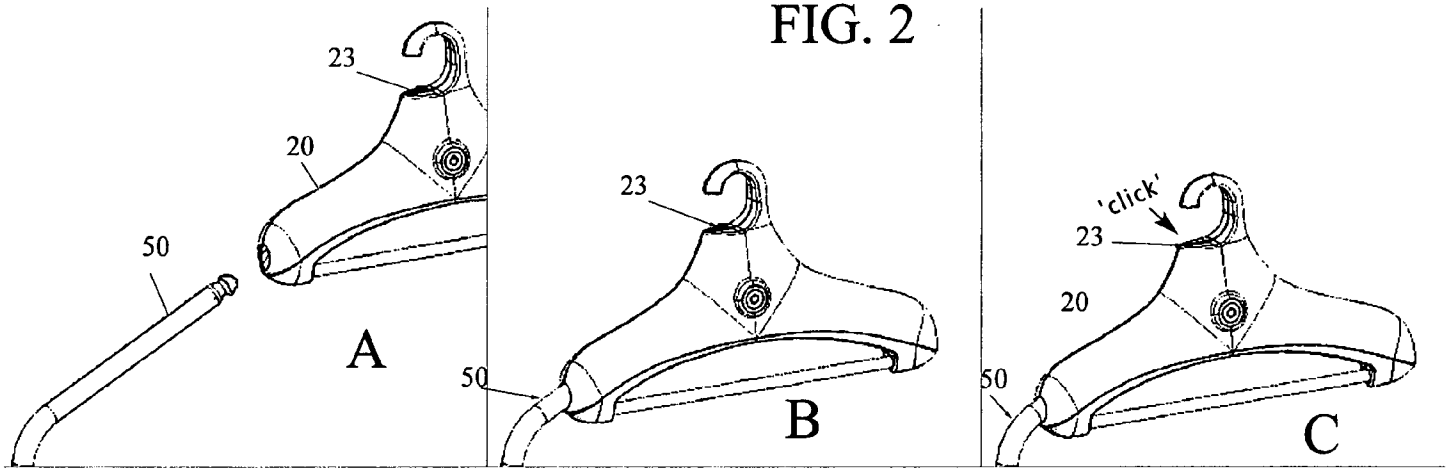
FIG. 3 is a close-up sequential illustration showing how the lock rod assembly 50 is inserted into the channel formed in the hanger assembly 20.

FIG. 3 is a close-up sequential illustration showing how the lock rod assembly 50 is inserted into the channel formed in the hanger assembly 20 and is releasably locked in place. As shown at A, the lock rod assembly 50 nears the hanger assembly 20 at an angle generally corresponding to the angle of the arm of the hanger assembly 20. As seen at B, the lock rod assembly 50 is inserted into a channel formed in the hanger assembly 20. As seen at C, when the lock rod assembly 50 is fully inserted into the channel formed in the hanger assembly 20 an internal locking mechanism (to be described) engages and the lock rod assembly 50 is locked in place with a "click.". The locking device is at the center of the hanger assembly and maintains the attachment of the hanger assembly 20. The locking device is keyed at the front of the hanger assembly 20 and may be locked or unlocked thereby. The locking device includes an indicator mechanism 22 (to be described) includes an indicator flag 23 which shows the status of the locking mechanism. When the lock is unlocked the lock rod assembly 50 may be easily extracted so that the garment can be removed.

Figure 4:
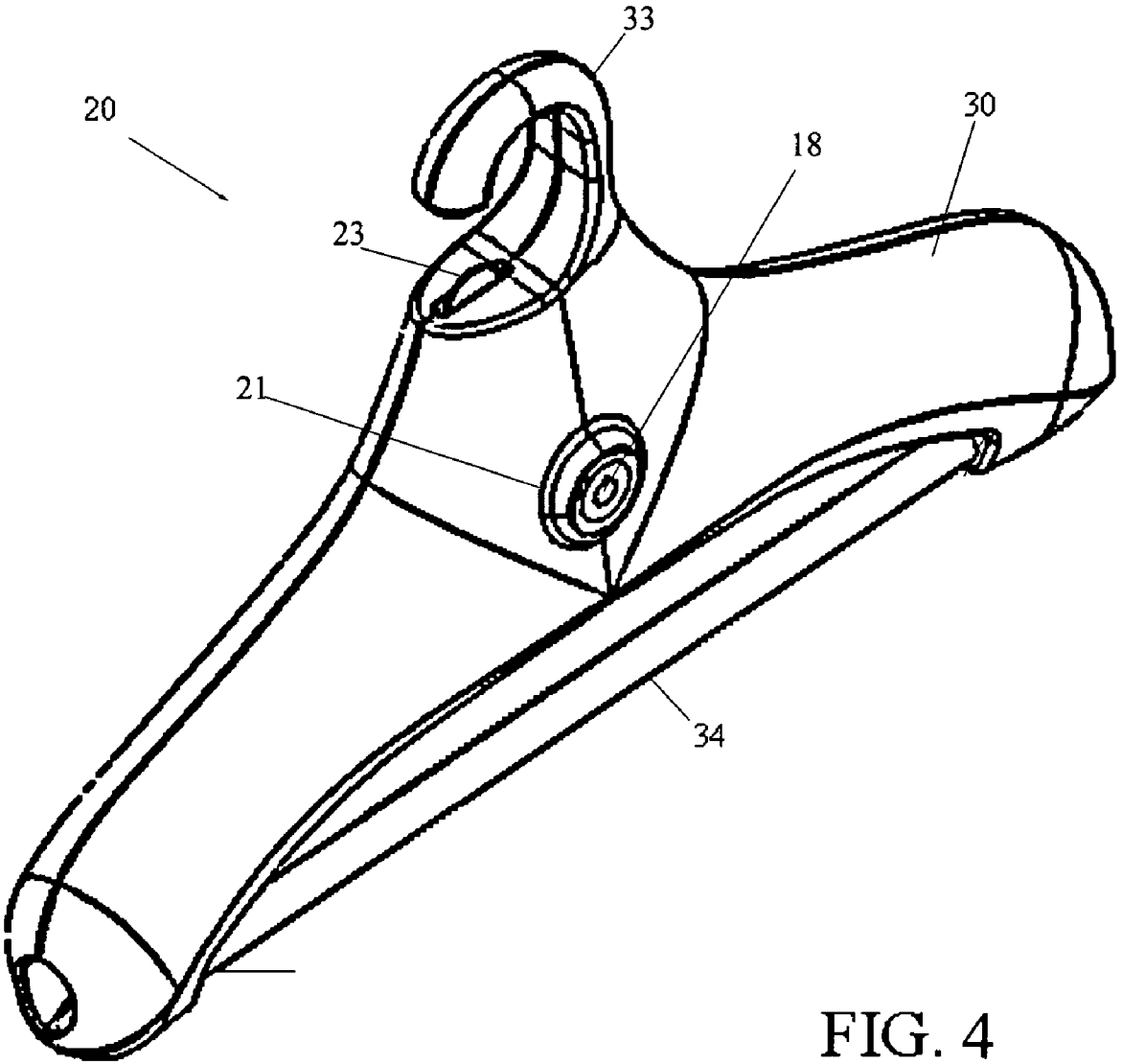
FIGS. 4–6 are, respectively, front perspective, front cross-sectional, and exploded perspective views of the hanger assembly 20 of FIGS. 1–3.
Figure 5:
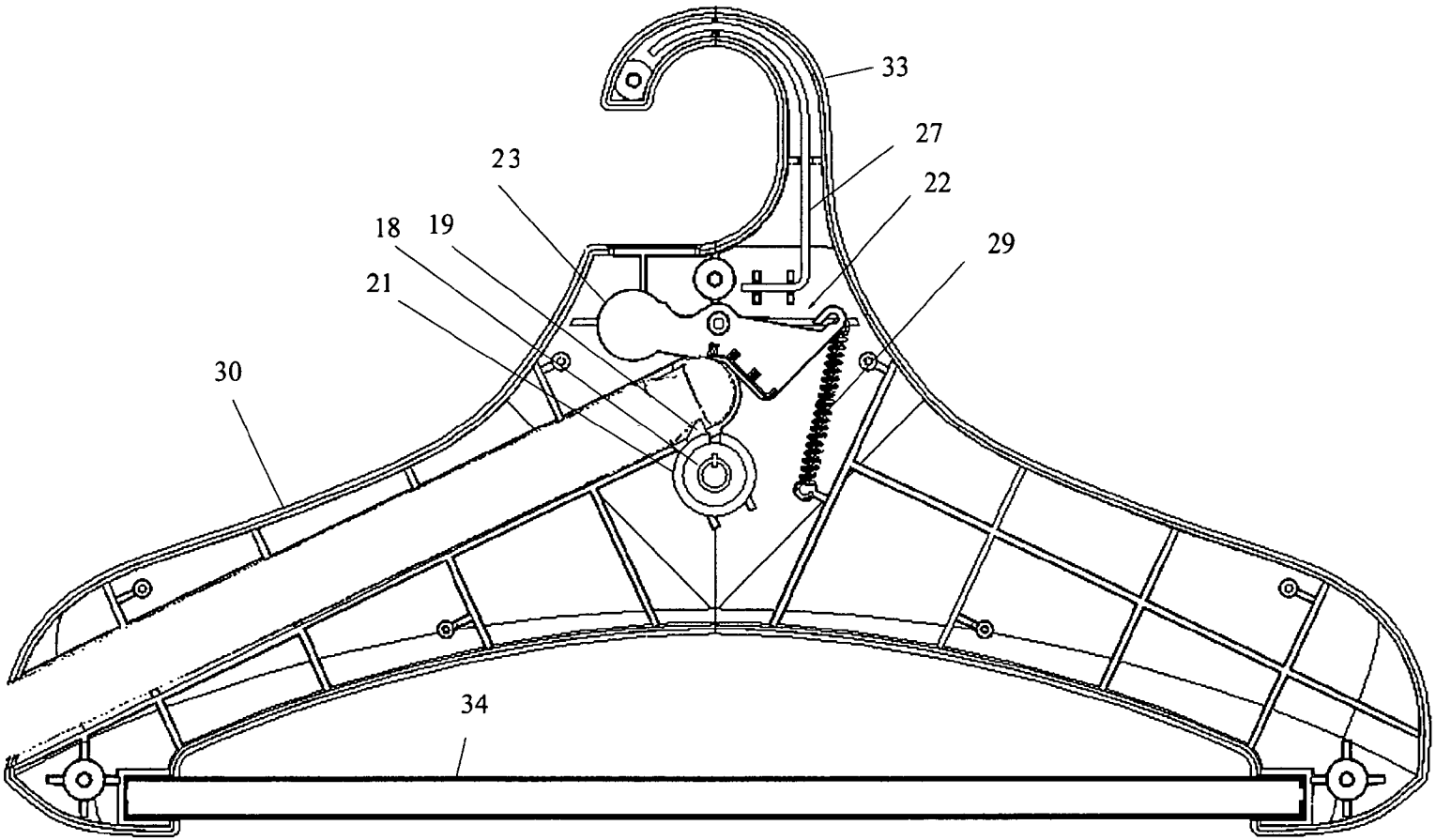
Figure 6:
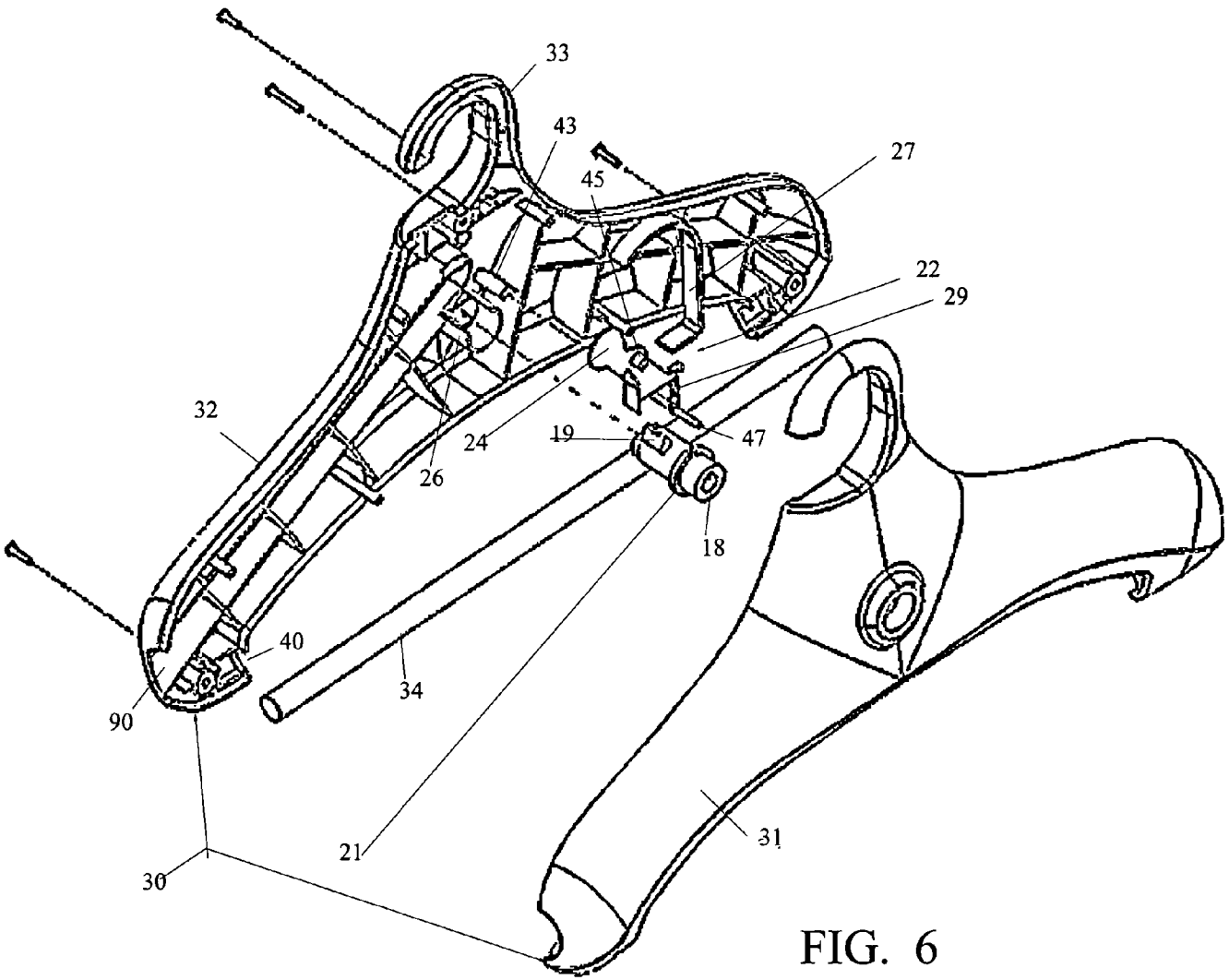

FIGS. 4–6 are, respectively, front perspective, front cross-sectional, and exploded perspective views of the hanger assembly 20 of FIGS. 1–3. The hanger assembly 20 generally comprises a two-piece hanger body 30, an integral locking device 21, and an indicator mechanism 22. The hanger body 30 typically comprises a front housing 31, a mating back housing 32, a hooked neck 33, a cross member 34, and a plurality of commercially-available screws (as shown) for securing the front housing 31 and back housing 32 together. The locking device 21 generally comprises a keyed tubular, or barrel, lock with a rotatable latch 19 that is rotated by the insertion and turning of a key (not shown in the Figures) in a keyslot 18. The indicator mechanism 22 typically comprises an indicator 23 that selectively protrudes upward through hanger body 30 upon engagement by a fully inserted lock rod 50, and a bias spring 29 to keep the indicator 23 in a normally retracted position. The front and back housings 31, 32 and the indicator 23 may be molded from commercially-available, hard plastic such as PVC. The neck 33 may be integrally molded as shown, and may be reinforced or may be a separate metallic strut 27 as shown, fabricated from commercially-available, 14-gauge wire. The cross member 34 is preferably round in cross-section and fabricated from wood or plastic, albeit other metal materials may be utilized. The locking device 21 is preferably fabricated of hardened steel, however, any material possessing-the durability to withstand the forces/pressures generated by the repeated locking and unlocking of the device 21 (see discussion below) may be utilized.

As seen in FIG. 6, the hanger assembly 20 is assembled generally by installing all components into the rear housing 32, and then attaching the front housing 31. With the rear housing 32 positioned open side (or inside surface) up and lying on a substantially flat, horizontal surface, a pivot pin 45 of the indicator 24 is inserted into a post 43 formed with a distal cavity in the rear housing 32. One end of the extension spring 29 is then attached to the indicator 23 via a hole 41 (see FIG. 6) proximate its narrow end. The other end of the extension spring 24 is anchored to the frame 30, such as to a lateral peg 47 that is inserted into corresponding holes in both the front and rear housings 31, 33. The locking device 21 is inserted into a cavity 26 formed in the rear housing 32. The neck reinforcing bracket 27 may then be placed in position within the rear housing 32 such that its curved end aligns with the neck 33 of the rear housing 32. The cross member 34 is then be positioned with its ends residing in two cavities 40 formed in the rear housing 32. The front housing 31 may then be placed on top of the rear housing 32 such that a corresponding series of cavities and posts are brung into alignment. Finally, while holding the front housing 31 and back housing 32 together, the hanger assembly 30 is turned over and screwed together to enclose the locking device 21, indicator mechanism 22, neck reinforcing bracket 27, and the ends of the cross member 34. The foregoing assembly process results in a pivoting, spring-biased connection between the front/back housings 31, 32 and the indicator 22, a fixed connection between the reinforcing bracket 33 and the front/back housings 31, 32, a fixed connection between the cross member 34 and the front/back housings 31, 32, and a pivotal suspension of the locking device 21. The cooperating front housing 31 and back housing 32 also defines the internal channel 90 running on one side between an end of the hanger body 30 and the locking device 21 and indicator mechanism 22.

Figure 7:
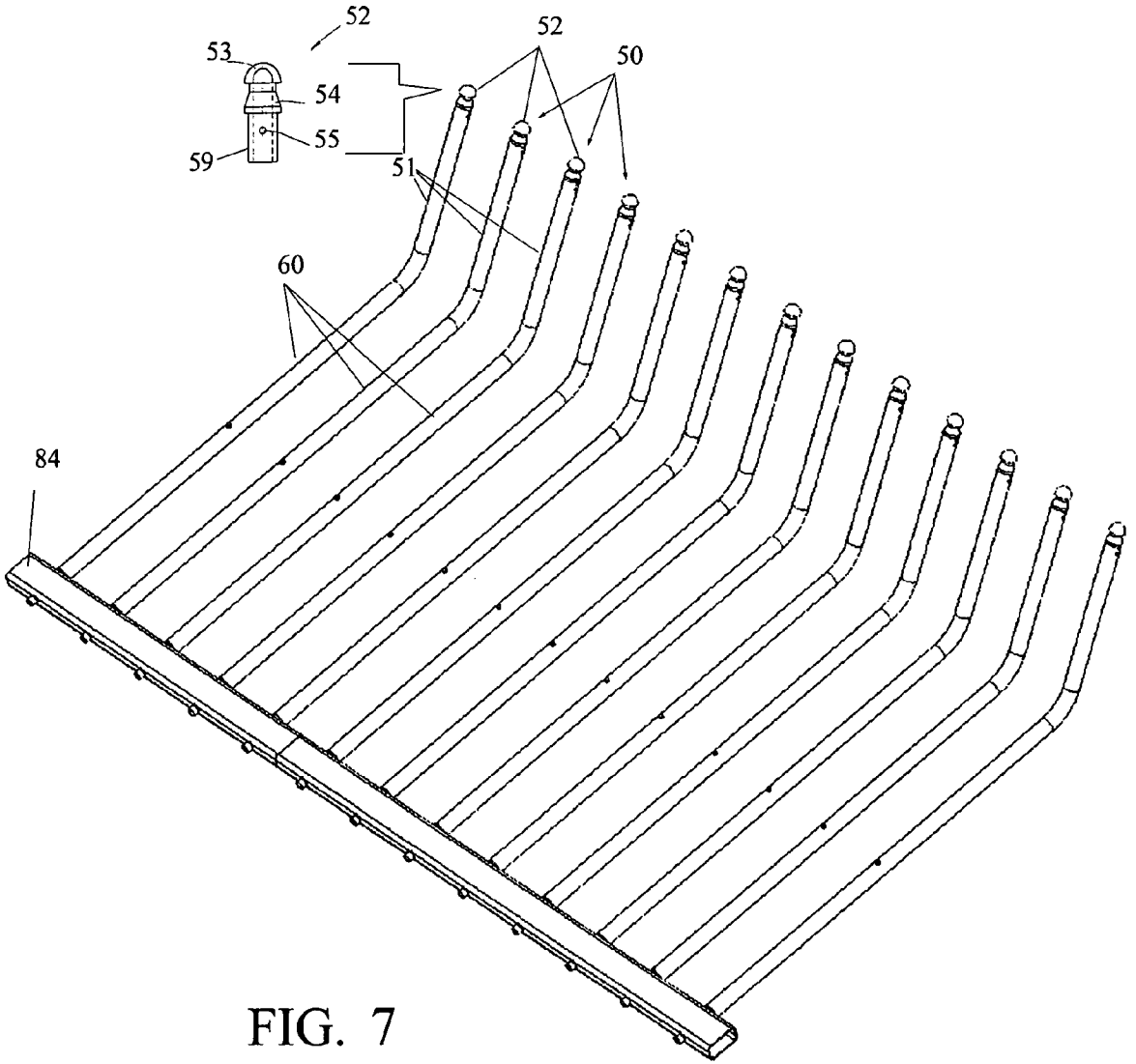
FIG. 7 is a side perspective view of a plurality of lock rod assemblies 50 with integral support bar assemblies 60 secured to a support bracket 84.

FIG. 7 is a side perspective view of a plurality of lock rod assemblies 50 with integral support bar assemblies 60 secured to a support bracket 84 according to a preferred embodiment of the present invention. Each lock rod assembly 50 generally comprises a lock rod 51 with a ball end 52, and a commercially-available dowel pin 59 by which it is inserted into the lock rod 51. The lock rod 51 is preferably a hollow, tubular member open at both ends and formed with a 56 E included angle located at a point that divides its overall length along roughly a 1:3 ratio. The ball end 52 (see blow up at left) is preferably a hollow, tubular member with one open end and one closed end. The closed end may be formed in the shape of a hemispherical tip 53. The ball end 52 is interrupted by an annular detent channel which leads to a tapering collar 54 formed proximate the midpoint of the ball end 52. A through hole 55 is located proximate the open end of ball end 52. Through hole 55 may be aligned with a corresponding through hole in the lock rod 51 and thereby provides the means for fixedly attaching the ball end 52 to the lock rod 51 via the installation (i.e. friction or press fit) of the dowel pin 59 once through holes are properly aligned. Proximate the midpoint of the longer section of the lock rod 51 may be a hole 58 that penetrates only one wall of the tubular rod 51. The lock rod 51 is preferably fabricated from commercially-available, steel tubular stock possessing a circular cross-section. The ball end 52 is preferably fabricated from commercially-available, steel round stock. However, metal materials other than steel (e.g. aluminum), or plastics possessing sufficient structural rigidity and strength, may be utilized.

Figure 8:
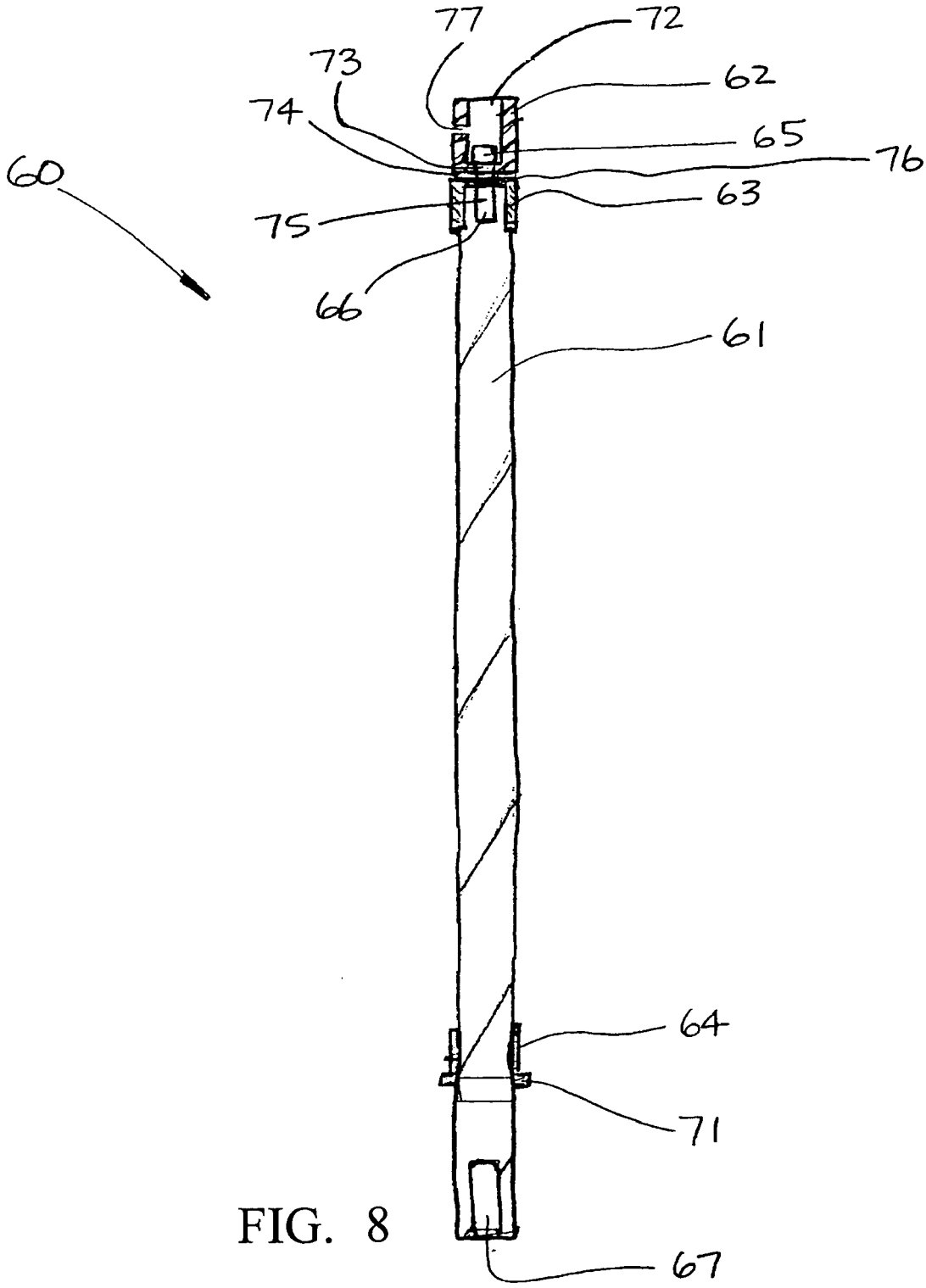
FIG. 8 is a side, cross-sectional view of a support rod assembly 60 for securement to the support bracket 84 as shown in FIG. 5.

FIG. 8 is a side, cross-sectional view of a support rod assembly 60 for securement to the support bracket 84 as shown in FIG. 6. The support rod assembly 60 generally comprises a support rod 61, a collar 62, a sleeve bearing 63, a flange bearing 64, and a commercially-available socket head cap screw 65. The support rod 61 is preferably a cylindrical member with threaded holes 66, 67 in each end, a turned-down section 68 at one end and a knurled finish 69 encircling the rod 61 proximate another end. The collar 62, sleeve bearing 63, and flange bearing 64 are preferably cylindrical members with through holes running along their central axes. The hole running through the collar 62 is larger in diameter at one end 72 than at the other end 73 (i.e. the larger diameter is sized to provide clearance for the head of the cap screw 65, the smaller diameter is sized to provide clearance for the screw's threads). The collar 62 may be formed with a tapped hole 77 positioned perpendicular to its central axis and extending through only one wall. The bearing 64 is preferably formed with a flange 71 encircling one of its ends.

The support rod 61 is preferably fabricated from commercially-available, steel round stock. The collar 62 is preferably fabricated from commercially-available, aluminum round stock. The sleeve bearing 63 and flange bearing 64 are preferably fabricated from commercially-available, PVC round stock. However, plastic and metal materials other than PVC and steel or aluminum may be utilized.

The support rod assembly 60 is assembled as follows. The flange bearing 64 is positioned along the support rod 61 such that its flange 71 is directed toward tapped hole 67 and its length completely overlaps the knurled finish 69. The sleeve bearing 63 may then be positioned over the turned-down section 68 of the rod 61. Once installed over the turned-down section, the distal end 76 of the sleeve bearing 63 extends slightly beyond the end of the rod 61 in which the tapped hole 66 is located. The collar 62 may then be rotatably attached to the support rod 61 by inserting the cap screw 65 through the large diameter end 72, extending the screw's threaded end 75 through the small diameter end 73 of the collar, and threading the cap screw 65 into the tapped hole 66. The collar 62 is properly installed when a slight gap 74, preferably 0.05", remains between the distal end 76 of the sleeve bearing 63 and the collar 62.

Figure 9:
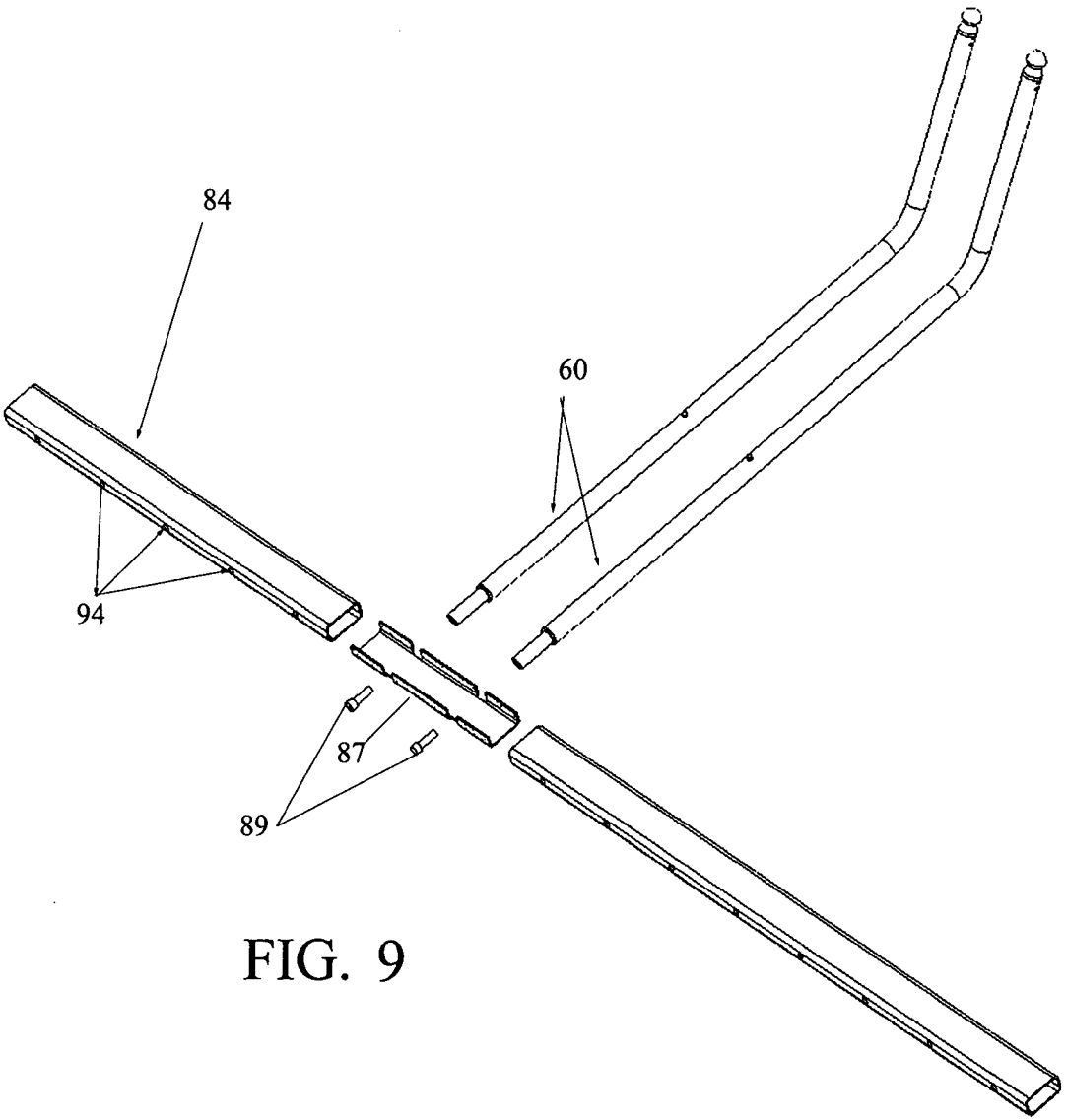
FIG. 9 is a perspective exploded view of a support rod assembly 60 as it is attached to the support bracket 84 as in FIG. 5.

FIG. 9 is a perspective exploded view of a support rod assembly 60 as it is attached to the support bracket 84 as in FIG. 7. Support bracket 84 is formed from tubular stock having a rectangular cross-section, and a plurality of equally-spaced holes 95 (obscured) are formed along the inner side-wall of the support bracket 84 to provide clearance for the ends (i.e. with tapped hole 67) of one or more support rod assemblies 60. Aligned holes 94 are formed along the outer side-wall of the support bracket 84 to provide clearance for the threaded ends of one or more of the assembly screws 89. Reinforcing inserts 87 are steel troughs with notches corresponding to the holes 94, 95 that are slidably inserted into the support bracket 84 to seat the support rod assemblies and to reinforce the junctions. As stated above, one or more support brackets 84 may be fixedly or detachably attached to a base such as the free-standing base assembly 80 of FIG. 1, or a wall mount, or otherwise, to display the garments.

Figure 11:
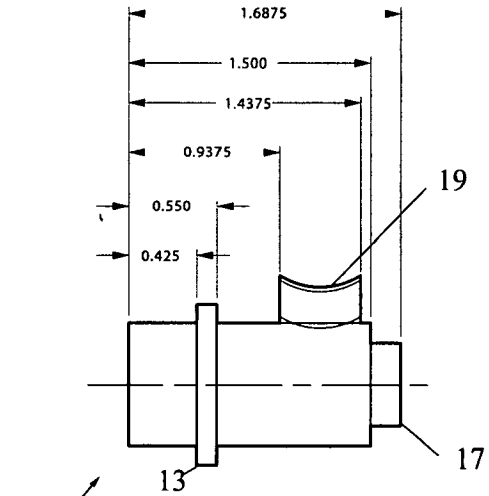
FIGS. 10–12 are, respectively, a perspective, side and end view of a locking device 21 according to a preferred embodiment of the present invention.
Figure 12:
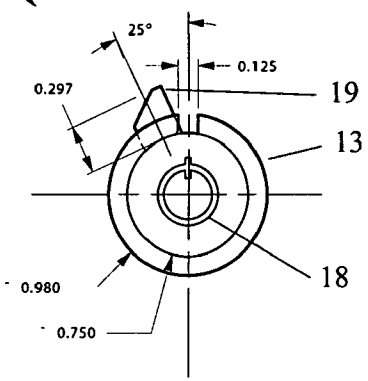
Figure 10:
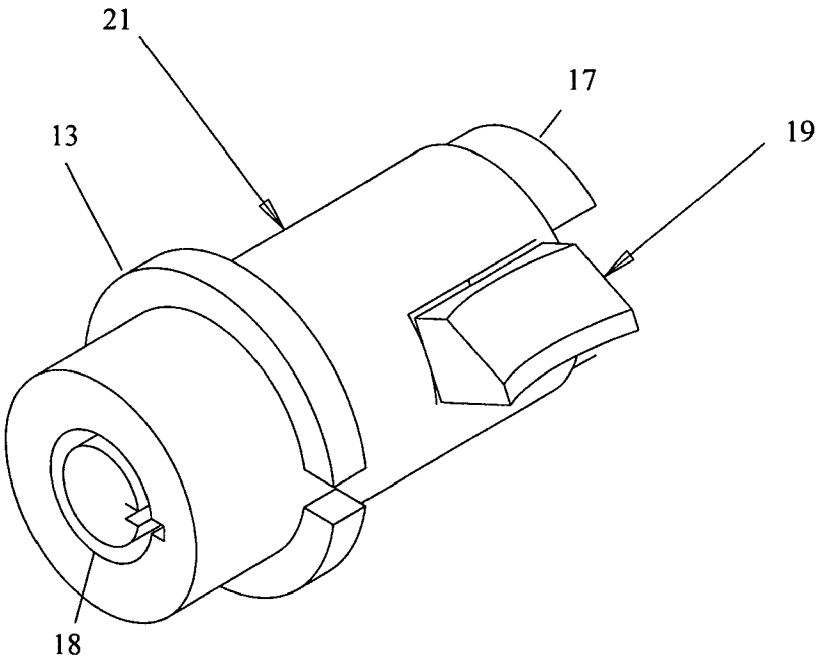
Figure 13:
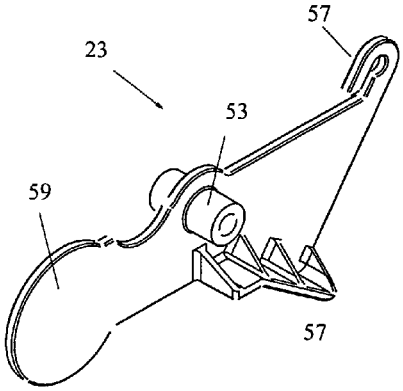
FIGS. 13–18 are, respectively, a perspective rear, front, end, rear side, top and front view of the indicator 23, which may be a molded or formed metal part.
Figure 16:
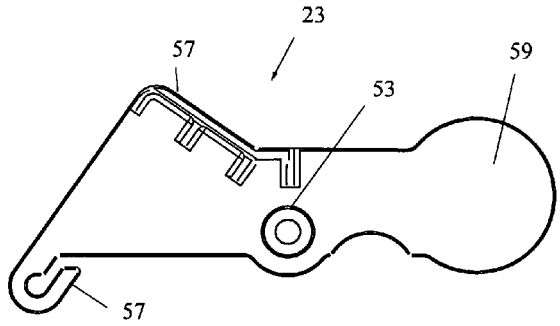
Figure 14:
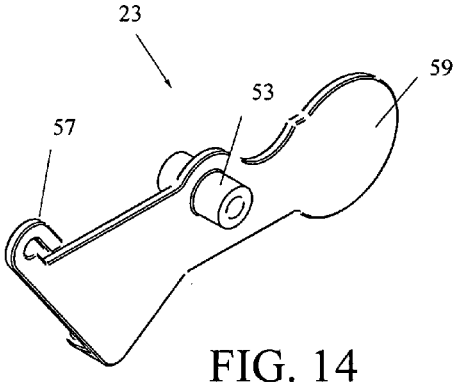
Figure 17:
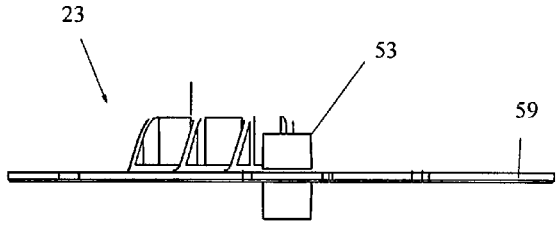
Figure 15:
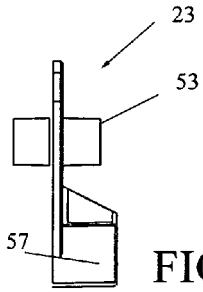
Figure 18:
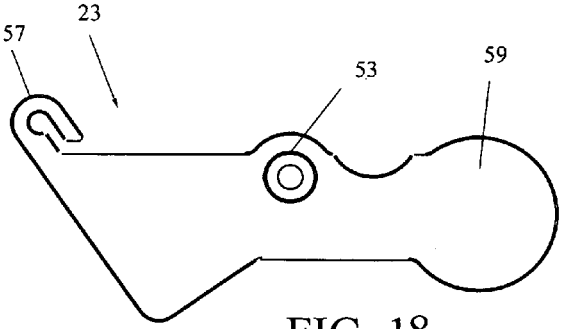

FIGS. 10–12 are, respectively, a perspective, side and end view of a locking device 21 according to a preferred embodiment of the present invention. As stated above, the locking device 21 generally comprises a keyed tubular, or barrel, lock with retractable latch 19 that is rotated by the insertion and turning of a key (not shown in the Figures) in a keyslot 18. The keyslot 18 is rotated 90 E between the locked and unlocked positions to cause the latch 19 to travel 0.150". As the keyslot 18 is rotated, the external section of the locking device 21 is held stationary by an annular keyed rib 17 protruding from the rear of locking device 21 and which is anchored in the cavity 26 in the rear housing 32 (see FIG. 6). The locking device 21 is further held in position within the hanger body 30 via the interaction of a keyed retaining collar 13 protruding toward the front of locking device 21 and which is anchored in the front housing 31 (see FIG. 6). In the locked position, the latch 19 interacts with the ball end 52 of the lock rod assembly 50 to hold the assembly 50 within the channel 90 formed in the hanger body 30. When unlocked, the ball end 52/latch 19 interference is eliminated and the lock rod assembly 50 may be extracted from the channel 90.

FIGS. 13–18 are, respectively, a perspective rear, front, end, rear side, top and front view of the indicator 23, which may be a molded or formed metal part. The indicator 23 is mounted via a reinforced hub 53 which carries the pin 47 of FIG. 6. One end of the extension spring 24 is fixedly attached to a hook 57 that protrudes from the indicator 23. The free end of the extension spring 24 is then be attached to a post formed in the rear housing 32. The indicator 23 also includes a brightly colored flag portion 59 that rises above the frame 30 to signal an engaged ball end 52 of a lock rod assembly 50. When the an ball end 52 of the lock rod assembly snaps into position (locked by the latch 19 as described above), the ball end 52 engages a reinforced abutment plate 56 and displaces the indicator 23, causing it to pivot about hub 53. This moves the flag portion 59 out of the frame 30 where it visibly indicates a locked lock rod assembly 50.

The hanger assembly 20 of FIGS. 1–2 may be mounted on a free-standing floor assembly as shown in FIG. 1, or alternatively on a wall mount. The free-standing floor mount of FIG. 1. includes a base assembly 80. With reference to FIG. 1, the base assembly 80 generally comprises a base 81 with four castor-wheeled legs 85 joined to a mounting collar 86, a post 82, and an upper mounting bracket 83 having a post collar for mounting atop post 82. One or more multi-rod support brackets 84 are anchored to the upper mounting bracket 83 by outwardly extending support arms 89 that conform to support brackets 84 for lateral support. The upper mounting bracket 83 typically comprises a hollow, tubular central core with outwardly extending arms 89 to which support brackets 84 may be fixedly (e.g. welded) or detachably (e.g. bolted) attached. The height of the overall apparatus 10, and the garments displayed thereon, may be adjusted by adjusting the position at which the upper mounting bracket 83 is affixed to the post 82 along its length. Support brackets 84 that are detachable from the upper mounting bracket 83 facilitate the storage and configuration flexibility (e.g. display height for garments of different sizes/lengths, number of brackets 84 attached to the upper mounting bracket 83 in a given display configuration) of the present invention. Additionally, a support bracket 84 may be attached to a mounting bracket 83 such that the former is positioned parallel to the surface on which the apparatus 10 stands, or in an angled (e.g. 14 E) orientation to that surface. The base's legs 85, are preferably fabricated from commercially-available, steel bar or plate stock. Post 82 is tubular stock, and mounting brackets 86, 83 may be cast or formed metal. However, with each of the components mentioned in this paragraph, metal materials other than steel (e.g. aluminum), or plastics possessing sufficient structural rigidity and strength, may be utilized. For the support brackets 84, tubular cross-sections other than rectangular (i.e. square) could be used.

With collective reference to FIGS. 1–18, the overall assembly of the garment security and display apparatus 10 of the present invention is completed as follows. First, a lock rod assembly 50 is pivotally attached to each of the support rod assemblies 60. This is accomplished by sliding the open end of the longer section of the lock rod 51 over a substantial portion of the support rod assembly 60 (i.e. the collar 62, the sleeve bearing 63, the mid-section of the support rod 61, and the small end of the flange bearing 64) until it abuts the flange 71 of the bearing 64. After rotating the rod 51 to align hole 58 with hole 77, an assembly screw (not shown in the Figures) may then be inserted through the hole 58 in the lock rod 51 to engage the tapped hole 77 in the support rod assembly's collar 62.

Next, the one or more pre-assembled combinations of lock rod assemblies 50 and support rod assemblies 60 are detachably attached to the multi-rod support brackets 84. This is accomplished by inserting an end of a rod assembly 60 (i.e. the end possessing tapped hole 67) through one of the holes 94 until it abuts the internal surface of the opposing wall 97. An assembly screw 89 may then be inserted through the opposing hole 95 and threaded into the tapped hole 67 in the end of the rod assembly 60. This process is repeated until the user-defined or -desired number of lock rod assemblies 50 and support rod assemblies 60 have been installed.

Finally, a hanger assembly 20 may be releasably attached to each of the lock rod assemblies 50 by inserting the ball end 52 and the shorter section of the lock rod 51 into the channel 90 formed in the hanger body 30 until the hemispherical tip 53 engages the locking device 21 and indicator mechanism 22. The releasable engagement of the hanger assembly 20 with the lock rod assembly 50 pivots the indicator mechanism 22 such that its substantially circular end 43, which protrudes slightly outside of the hanger body 30 just below the housing's curved section 39 when the locking device 21 is not engaged (see FIG. 2) with a lock rod assembly 50, disappears into the hanger body 30.

The present invention provides for the placement of a garment on a hanger assembly 20 before the hanger assembly 20 is releasably attached to a lock rod assembly 50. To facilitate the attachment of the hanger assembly 20 to the lock rod assembly 50, the lock rod assembly 50 is typically inserted through a sleeve of the garment before being inserted into a channel 90 formed in the hanger body 30. When the lock rod assembly 50 is fully inserted into the channel 90, the locking device 21 is engaged to maintain the attachment of the hanger assembly 20 to the lock rod assembly 50. An indicator mechanism 22 is also engaged to provide visual affirmation that the hanger assembly 20 and the lock rod assembly 50 are locked together. The pivoting attachment between a lock rod assembly 50 and a support rod assembly 60 facilitates browsing (i.e. the slight separation of one garment from another) by a consumer among the plurality of garments securely displayed on an apparatus 10.

To facilitate the detachment of the hanger assembly 20 from the lock rod assembly 20 (i.e. when a consumer wants to try on, or purchase, the garment), the locking device 21, located proximate the center of the hanger assembly 20 (i.e. lock access orifice 44) in a position that is typically unobstructed by any part of the garment, is unlocked allowing the lock rod assembly 50 to be extracted from the channel 90 and the sleeve of the garment.

The present invention is fabricated of strong, lightweight materials chosen to provide an appropriate degree of durability/longevity. The present invention possesses a simple, yet scalable, design that may be economically manufactured and sold to provide for widespread use.

Alternative embodiments of the present invention include a wide variety of base assemblies 80 possessing any one of a wide variety of configurations. These include, but are not limited to, floor-mounted base assemblies with and without casters and wall-mounted variations designed to support one or more support rod assemblies 60, one or more lock rod assemblies 50, and one or more hanger assemblies 20 in a variety of display arrays.

Figure 19:
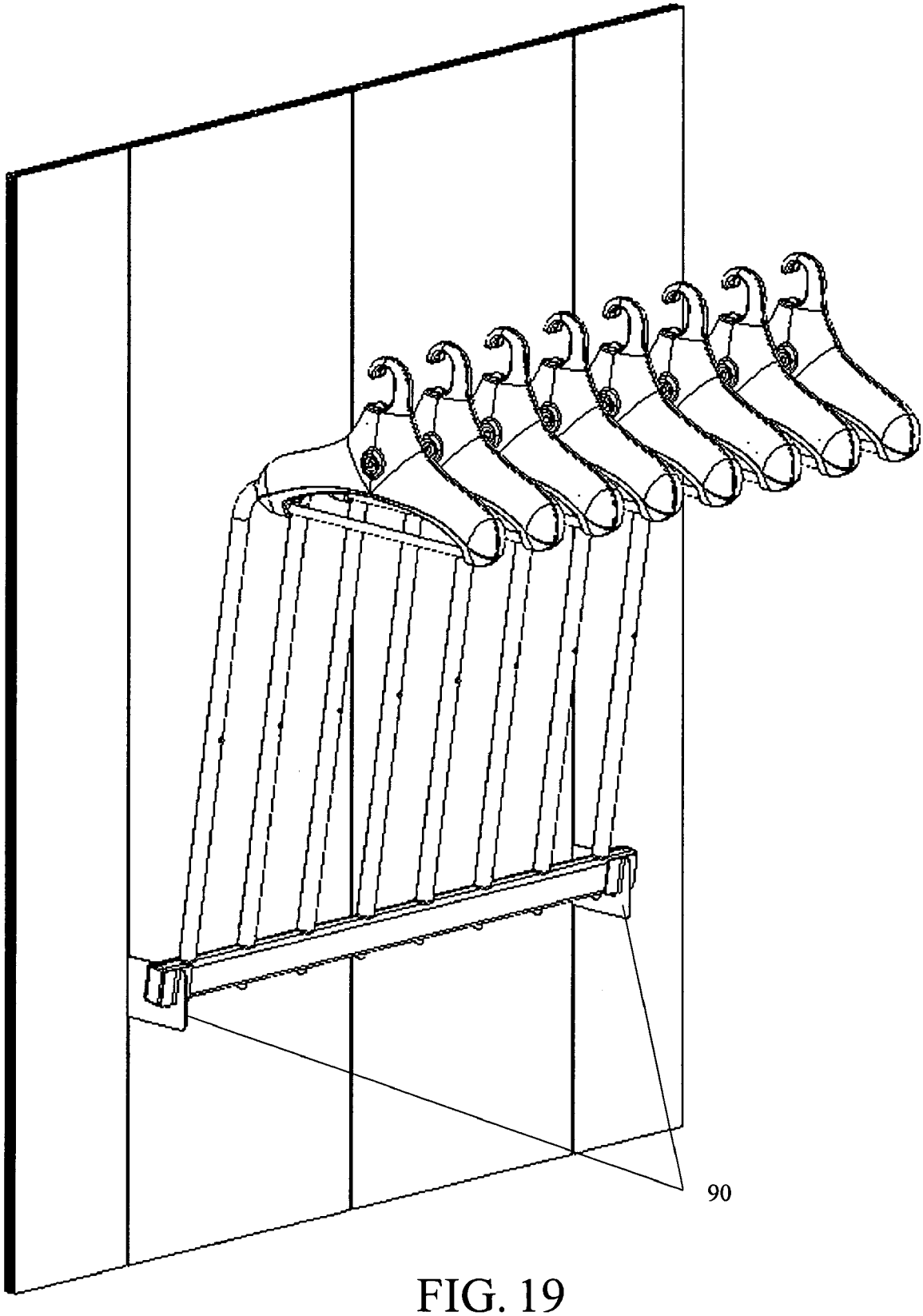
FIG. 19 is a perspective view of a wall-mounted configuration in which the support brackets 84 are held in wall-mounted yokes 90 having rectangular receptacles for support.

For example, FIG. 19 illustrates a wall-mounted configuration in which the support brackets 84 are held in wall-mounted yokes 90 having rectangular receptacles for support.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

We claim:

1. A garment security hanger, comprising: a support rod fixedly attached at one end to a base and having, at the other end, a tip with an annular detent channel; a hanger assembly including a hanger body with a hooked neck, opposing hanger arms for hanging a garment, and a passage into one of said hanger arms for insertion of the tip of said support rod, said hanger assembly further including a lock mounted therein and having a latch for engaging the detent channel of said support rod for selectively locking said support rod into said hanger assembly, wherein said hanger assembly further comprises an indicator for indicating when said support rod is locked into said hanger assembly.

2. A garment security hanger comprising: a support rod fixedly attached at one end to a base and having, at the other end, a tip with an annular detent channel; a hanger assembly including a hanger body with a hooked neck, opposing hanger arms for hanging a garment, and a passage into one of said hanger arms for insertion of the tip of said support rod, said hanger assembly further including a lock mounted therein and having a latch for engaging the detent channel of said support rod for selectively locking said support rod into said hanger assembly, wherein said hanger assembly further comprises an indicator for indicating when said support rod is locked into said hanger assembly, wherein said indicator further comprises a pivoting member mounted in said hanger body and engageable with the tip of said support rod when locked into said hanger assembly to pivot said pivoting member into an indicating position.

3. A garment security hanger and display apparatus comprising: a base; a support bracket fixedly attached to said base; a plurality of support rods having one end fixedly attached to said support bracket and extending parallely there from, each of said support rods having, at the other end, a tip with an annular detent channel; a plurality of hanger assemblies each including a hanger body with a hooked neck, opposing hanger arms for hanging a garment, and a passage into one of said hanger arms for insertion onto the tip of a corresponding one of said support rods, said hanger assembly further including a lock mounted therein and having a latch for engaging the detent channel of said support rod for selectively locking said support rod into said hanger assembly, wherein said hanger assembly further comprises an indicator for indicating when said support rod is locked into said hanger assembly.

4. A garment security hanger and display apparatus comprising: a base; a support bracket fixedly attached to said base; a plurality of support rods having one end fixedly attached to said support bracket and extending parallely there from, each of said support rods having, at the other end, a tip with an annular detent channel; a plurality of hanger assemblies each including a hanger body with a hooked neck, opposing hanger arms for hanging a garment, and a passage into one of said hanger arms for insertion onto the tip of a corresponding one of said support rods, said hanger assembly further including a lock mounted therein and having a latch for engaging the detent channel of said support rod for selectively locking said support rod into said hanger assembly, wherein said hanger assembly further comprises an indicator for indicating when said support rod is locked into said hanger assembly, wherein said indicator further comprises a pivoting member mounted in said hanger body and engageable with the tip of said support rod when locked into said hanger assembly to pivot said pivoting member into an indicating position.

* * * * *